US006913497B1

(12) United States Patent
Ahlswede et al.

(10) Patent No.: US 6,913,497 B1
(45) Date of Patent: Jul. 5, 2005

(54) TANDEM CONNECTION SYSTEM FOR TWO OR MORE MARINE PROPULSION DEVICES

(75) Inventors: Scott G. Ahlswede, Plymouth, WI (US); Donald Anderson, Jr., Oshkosh, WI (US); Martin E. Olson Gunderson, Oshkosh, WI (US); Jeremy L. Alby, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/811,740

(22) Filed: Mar. 29, 2004

(51) Int. Cl.[7] ..... B63H 5/25
(52) U.S. Cl. ..... 440/63; 74/579 R
(58) Field of Search ..... 440/53, 61 R, 440/62, 63; 74/579 R, 586

(56) References Cited

U.S. PATENT DOCUMENTS

| | | | | |
|---|---|---|---|---|
| 4,009,678 A | | 3/1977 | North | |
| 4,311,471 A | * | 1/1982 | Queen | 440/63 |
| 4,731,035 A | | 3/1988 | Wagner | 440/61 |
| 4,778,418 A | * | 10/1988 | Mondek | 440/63 |
| 4,836,812 A | | 6/1989 | Griffiths | 440/61 |
| 5,370,075 A | * | 12/1994 | Rodskier | 440/63 |
| 5,505,106 A | * | 4/1996 | Herman | 74/586 |
| 6,406,340 B1 | | 6/2002 | Fetchko et al. | 440/61 |
| 6,561,860 B2 | | 5/2003 | Colyvas | 440/61 |
| 6,699,082 B2 | * | 3/2004 | Zeiger | 440/63 |

* cited by examiner

*Primary Examiner*—S. Joseph Morano
*Assistant Examiner*—Lars A. Olson
(74) *Attorney, Agent, or Firm*—William D. Lanyi

(57) ABSTRACT

A connection system for connecting two or more marine propulsion devices together provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

38 Claims, 8 Drawing Sheets

TANDEM CONNECTION SYSTEM FOR TWO OR MORE MARINE PROPULSION DEVICES

BACKGROUND OF THE INVENTION

1. Field of the Invention

The present invention is generally related to a connection system for connecting two or more marine propulsion devices together and, more particularly, to a system that simplifies and strengthens a tie bar system for operating two or more outboard motors in tandem.

2. Description of the Prior Art

It is well known by those skilled in the art that two or more marine propulsion devices can be used in tandem on a marine vessel. When two or more outboard motors are used in this manner, a tie bar or connecting link is used to connect the outboard motors together so that they can be steered in tandem to allow the marine vessel to be maneuvered with both marine propulsion devices operating cooperatively.

U.S. Pat. No. 6,406,340, which issued to Fetchko et al. on Jun. 18, 2002, describes a twin outboard motor hydraulic steering system. The steering assembly applies a force to tiller arms of twin marine, outboard propulsion units and rotates the propulsion units about a steering axis between a center position and hard over positions to each side of the center position. Each propulsion unit is supported for arcuate movement about a tilt axis which is generally perpendicular to the steering axis. There is a hydraulic steering apparatus mounted on a first of the propulsion units which includes a hydraulic cylinder pivotally connected to a member which is pivotally mounted on the tiller arm of the first propulsion unit. A tie bar is pivotally connected to the steering apparatus and pivotally connected to the tiller arm of a second propulsion unit. For example, the tie bar may be pivotally connected to the steering apparatus by a ball joint connected to the steering apparatus by a bracket which moves with the member.

U.S. Pat. No. 4,836,812, which issued to Griffiths on Jun. 6, 1989, discloses a steering system for an auxiliary marine engine. The steering system for controlling an auxiliary marine engine includes an auxiliary engine steering cable operably connected to the hydraulic cylinder of the steering system for the primary engine so that linear movement of the hydraulic cylinder results in movement of the steering cable and pivotal steering of the auxiliary engine.

U.S. Pat. No. 4,731,035, which issued to Wagner on Mar. 15, 1988, describes a steering mechanism for outboard motors. The mechanism is disclosed for a boat equipped with an outboard motor. The steering mechanism has a pair of opposed single acting cylinders maintained in a spaced relationship by a frame member. A pair of brackets enables pivotal connection of the steering mechanism with the mounting bracket of the motor. A piston is received in and extends between the cylinders and carries a lost motion linkage connectable with the tiller arm of the motor to induce steering movement of the motor upon actuation of the piston.

U.S. Pat. No. 6,561,860, which issued to Colyvas on May 13, 2003, describes a maneuvering enhancer for twin outboard motor boats. An adjustable length bar is used to replace the rigid bar, the one connecting the two outboards or the two outdrives of a boat, for steering purposes. The adjustable bar is electrically operated through a switch on the boat's dashboard, the switch having two operating positions. One position is to keep propellers creating two parallel thrusts and a second position is to shift the propellers to create a vee configuration, by which the boat's maneuverability will be enhanced.

U.S. Pat. No. 4,009,678, which issued to North on Mar. 1, 1977, discloses a multiple push-pull cable transmission apparatus. A racing boat is powered by a pair of pendent inboard-outboard drive units having inboard steering arms. A pair of push-pull cable units connect a forward located steering wheel unit to the arms. The cable units extend along opposite sides of the boat with the casing fixed at the steering wheel and the core wires secured to the opposite sides of the steering wheel and to the opposite steering arms. A power steering unit coupled to the one steering arm has an input element. The adjacent cable unit has a threaded extension pipe with a fixed coupler connected to the power control input. A core rod is connected to the core and is slidably mounted in the pipe and is pivotally connected to the power steering link to transmit casing reaction forces to the power input. An adjustable rigid linkage includes a tie rod having adjustable ends pivotally connected to the anchor member on the extension pipes. The anchor member of the second cable unit is slidably mounted in a pivotally mounted support for generally linear movement. The rod directly interconnects the two anchor members to each other and to the power input for rapid power steering response. A second adjustable tie rod is pivotally connected to the arms and the core wires and is set to properly locate the steering arms.

The patents described above are hereby expressly incorporated by reference in the description of the present invention.

Known tie bar systems for tandem steering of two or more outboard motors typically exhibit two inherent problems. First, adjusting the various elements of the system during installation can be exceedingly difficult when using known tie bar systems. In addition, the structure of the individual joints, about which the various linkages rotate, can place the components under undue stress because of the lack of alignment between certain forces and their reactions. It would therefore be significantly beneficial if a tandem outboard motor steering system could be provided which is easier to assemble and adjust than known systems and which directs reactive forces in alignment with original forces to avoid creating moments that can otherwise be destructive to individual components.

SUMMARY OF THE INVENTION

A connection system for connecting two marine propulsion devices together, in a preferred embodiment of the present invention, comprises a first tie bar arm, which is attachable to a first one of the two marine propulsion devices, and a first connecting link which is pivotally connectable to the first tie bar arm for rotation about a first axis. It also comprises a first rod assembly which is pivotally connectable to the first connecting link for rotation about a second axis and a coupler which is attachable in a first direction of threaded association with the rod assembly. It further comprises a second rod assembly which is attachable in a second direction of threaded association with the coupler. The first and second directions of threaded association are opposite to each other.

The present invention further comprises a second connecting link which is pivotally connectable to the second rod assembly for rotation about a third axis. A preferred embodiment of the present invention further comprises a second tie bar arm which is attachable to a second one of the two marine propulsion devices. The second tie bar arm is pivotally connectable to the second connecting link for rotation about a fourth axis.

The first tie bar arm can comprise a first attachment plate and a second attachment plate. The first and second attachment plates are generally parallel to each other. The first connecting link is disposable between the first and second attachment plates. The first axis extends through the first and second attachment plates and also through the first connecting link.

The first connecting link comprises a first clevis end. The first rod assembly is disposed within the first clevis end. The second axis extends through the first rod assembly and through the first clevis end. In one embodiment of the present invention, the first connecting link comprises a second clevis end which is disposed between the first and second attachment plates. The first axis extends through the first and second attachment plates and through the second clevis end. The second clevis end is shaped to receive an extension portion of a third connecting link. The first and second axes extend in directions which are perpendicular to each other and these first and second axes are associated in nonintersecting relation with each other in a preferred embodiment.

The first direction of threaded association employs a right handed thread and the second direction of threaded association employs a left handed thread. As a result, the first and second rod assemblies are moved toward each other in response to rotation of the coupler in a first rotational direction about its central axis and the first and second rod assemblies are moved away from each other in response to rotation of the coupler in a second rotational direction about its central axis. The first and second rotational directions are opposite to each other.

The present invention can further comprise a bolt extending through the first tie bar arm and through the first connecting link coaxially with the first axis. The bolt can be a shoulder bolt which is sized to retain the first connecting link in an uncompressed state between the first and second attachment plates. At least one flanged radial bearing is disposed around the bolt and between the first and second attachment plates. The present invention can further comprise a non-flanged radial bearing disposed around the bolt and between the first and second attachment plates.

As a result of the present invention, a first resultant force exerted by the first connecting link on the first tie bar arm is symmetrical with a second resultant force exerted by the first tie bar arm on the first connecting link. The first and second resultant forces, which comprise an original force and a reactive force, are generally equal in magnitude and directed in opposite directions along a common axis. The first and second resultant forces combine to create approximately no net moment about any point.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
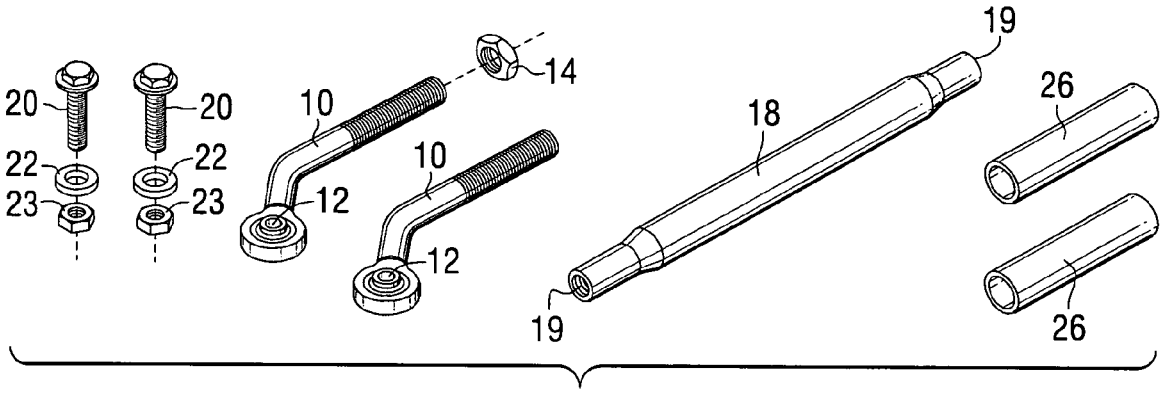
FIG. 1 PRIOR ART
FIGS. 1–3 illustrate the components and assembly of a prior art connection system.

Throughout the description of the preferred embodiment of the present invention, like components will be identified by like reference numerals.

In order to fully understand and appreciate the advantages provided by the present invention, it is necessary to first understand the current types of tie bar systems that are known to those skilled in the art. FIG. 1 shows a known assembly of components that is used to tie two outboard motors together. The assembly of components comprises two threaded steering rods 10 that are each provided with an opening 12 that can have a ball joint disposed therein. A locking nut 14 is provided. A coupler 18 is threaded at both ends, 19, so that either of the two threaded steering rods 10 can be attached to the coupler 18 in threaded association, one at each end 19. Bolts 20, washers 22 and nuts 23 are provided to attach the openings 12 of the threaded steering rods 10 to openings in steering arms of the outboard motors. Two flexible tubes 26 are used in conjunction with the coupler 18 and the threaded steering rods 10 in a manner that will be described below in conjunction with FIG. 2.

Figure 2:
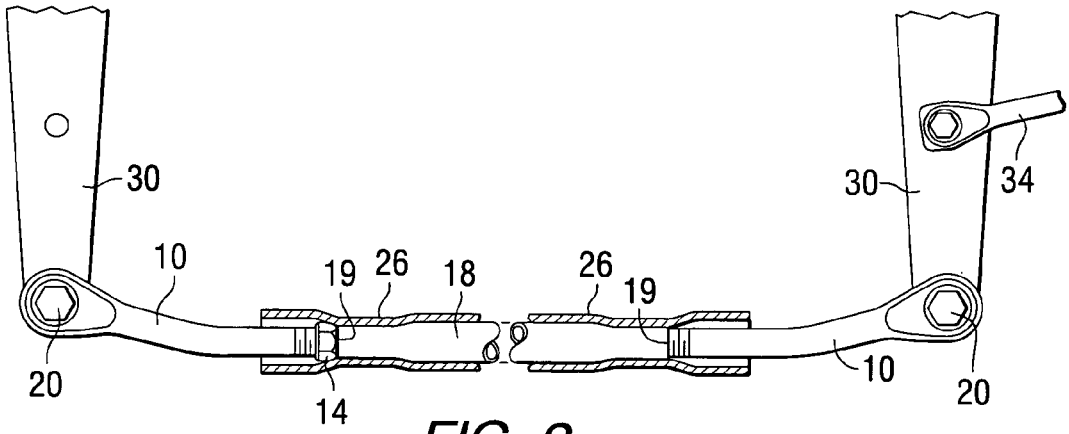
FIG. 2 PRIOR ART

FIG. 2 shows the components of FIG. 1 attached to two steering arms 30. Although not shown in FIG. 2, it should be understood that the steering arms 30 are attached to the outboard motors so that the arms can be used to cause the outboard motors to rotate about their respective steering axes.

In the assembly shown in FIG. 2, the threaded steering rods 10 are threaded into the ends 19 of the coupler 18. The locking nut 14 is used to prevent rotation of the coupler 18 relative to the threaded rods 10. The flexible tubes 26 are disposed over the ends 19 of the coupler 18, the threaded ends of the threaded arms 10, and the locking nut 14. Also shown in FIG. 2 is a steering drag link 34 which is attached to one of the two steering arms 30 to cause them to rotate about their respective steering axes. Although not shown in FIG. 2, the steering drag link 34 would typically be connected to a push-pull cable to allow the operator to cause the attached steering arm 30 to rotate. The connection between the two steering arms 30, provided by the coupler 18, the threaded steering rods 10, and the bolts 20 caused the two steering arms 30 to move in tandem with each other.

Figure 3:
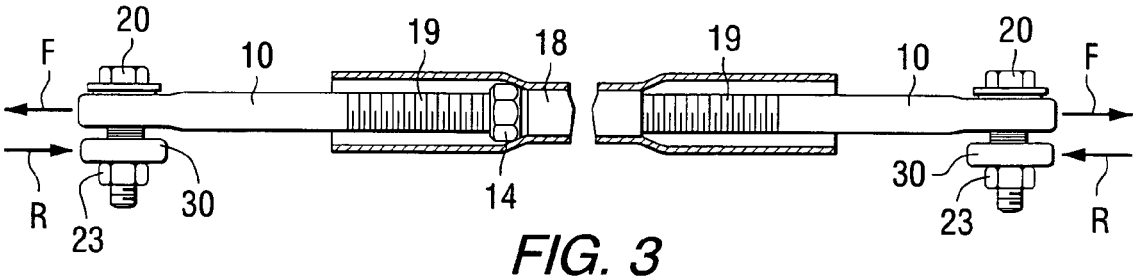
FIG. 3 PRIOR ART

FIG. 3 is an end view of the apparatus shown in FIG. 2. The items in FIG. 3 are identified by the same reference numerals used to identify them in FIGS. 1 and 2. As can be seen in FIG. 3, the force F of the threaded bar 10 on the bolt 20 creates a reactive force R by the steering arms 30 on the bolt 20. As illustrated in FIG. 3, the force F and the reactive force R are not aligned with each other in a coaxial manner. Instead, they are offset because of the physical relationship between the hole 12 of the threaded bar 10 and the hole extending through the steering arm 30. Because of this offset, forces F and reactive forces R cause a moment to exist about a point that is generally located within the structure of the bolt 20 and between the hole 12 and the threaded rod 10 and the hole in the steering arm 30. This moment can cause stress and significant damage over time.

With continued reference to FIGS. 1–3, it can also be seen that the assemblage of parts shown in FIG. 1 necessitate a potentially complex procedure to assemble the parts and align the two steering arms 30 in parallel association with each other. When the two threaded rods 10 are threaded into the ends 19 of the coupler 18, their two openings 12, in which ball joints are typically provided, are spaced apart by a defined distance. If this defined distance is precisely equal to the distance between the associated holes in the steering arms 30, the bolts 20 can be used to make the assembly shown in FIG. 2. However, if the holes 12 are not spaced apart by the same distance as the holes in the steering arms 30 when the two steering arms are perfectly parallel with each other, an adjustment has to be made. This adjustment is accomplished by rotating one or both of the threaded rods 10 relative to the coupler 18. This rotation, in turn, requires that the bolts 20 be removed to allow this rotation. If the adjustment is not satisfactory to connect the two steering arms 30 together while in perfectly parallel association with each other, the bolts 20 must again be removed and one or both of the threaded rods 10 must be rotated relative to the coupler 18 to adjust the distance between the holes 12. These steps must continue until the distance between the holes 12 in FIG. 2 equal the distance between the holes in the steering arms 30 when the steering arms 30 are parallel to each other.

With continued reference to FIGS. 1–3, it should be understood that the locking nut 14 is required in order to prevent the coupler 18 from moving toward one or the other of the steering arm 30 by rotating about its own axis. Since known systems use right hand threads on both threaded rods 10 and both ends 19 of the coupler 18, rotation of the coupler 18 about its central axis, even after attached to the threaded rods 10 is illustrated in FIG. 2, will cause the coupler to move either left or right in FIG. 2 and possibly to detach from one of the two threaded rods 10. Therefore, the locking nut 14 is jammed against one end of the coupler 18 to prevent rotation of the coupler 18.

With continued reference to FIGS. 1–3, it can be seen that the known type of tie bar arrangement, which is generally known to those skilled in the art and currently used in most applications, presents a cumbersome method for adjusting the distance between the holes 12 of the threaded rods 10 and, in addition, allows a moment to exist because of the offset between the force F and the reaction force R.

Figure 4:
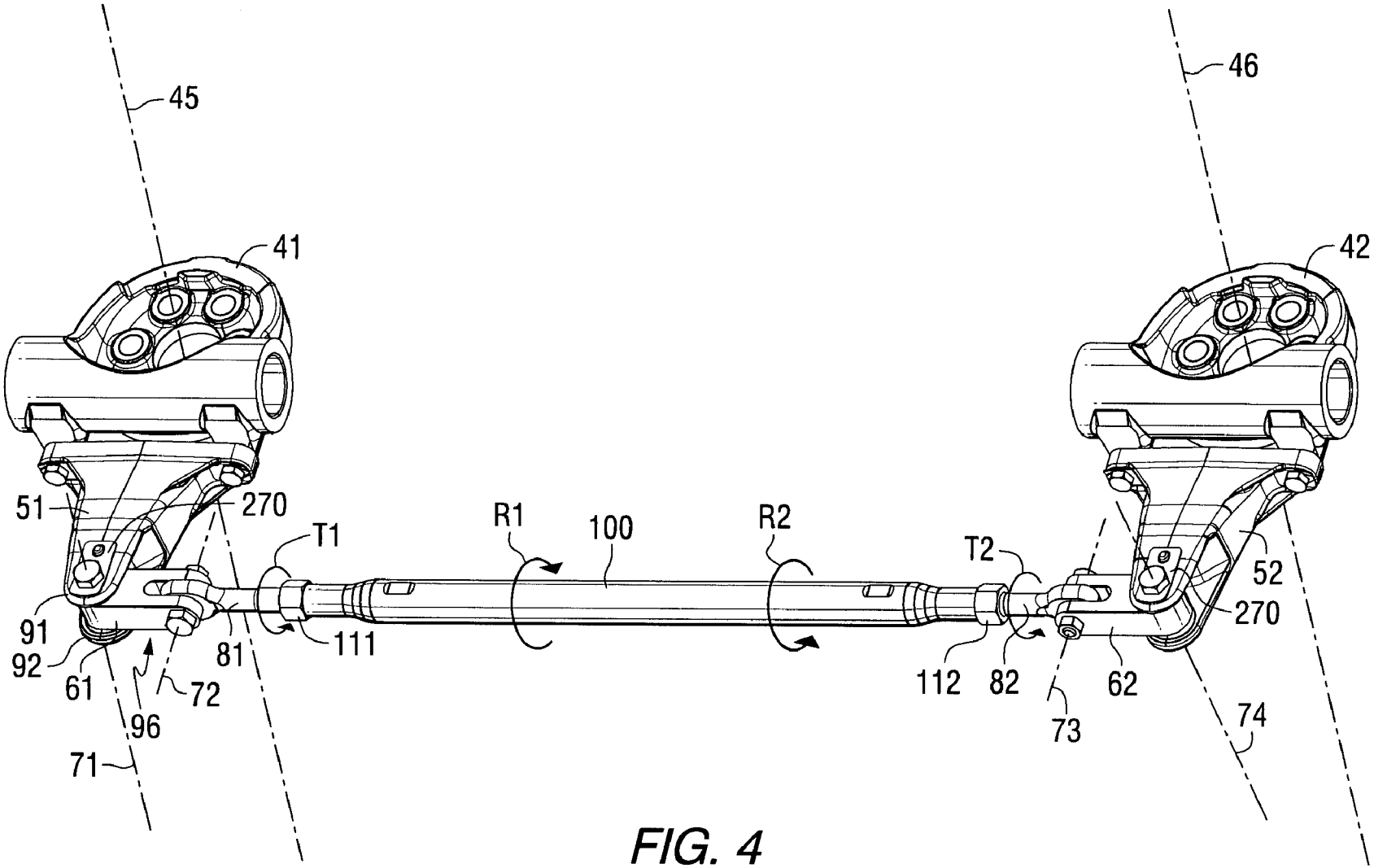
FIG. 4 is an isometric view showing the present invention used to connect two outboard motors together.

FIG. 4 shows the present invention used to connect two outboard motors in tandem with each other. Reference numerals 41 and 42 represent two rotatable elements that are part of two outboard motors. For clarity, the entire outboard motors are not shown. Steering axes 45 and 46 are the two steering axes of the two outboard motors, respectively. A first tie bar arm 51 is attachable to a first one of the two marine propulsion devices, or outboard motors. A first connecting link 61 is pivotally connectable to the first tie bar arm 51 for rotation about a first axis 71 relative to the first tie bar arm 51. A first rod assembly 81 is pivotally connectable to the first connecting link 61 for rotation about a second axis 91. A coupler 100 is attachable in a first direction of threaded association with the first rod assembly 81. A second rod assembly 82 is attachable in a second direction of threaded association with the coupler 100. The first and second directions of threaded association are opposite to each other. These two directions of threaded association are identified by arrows T1 and T2 in FIG. 4.

With continued reference to FIG. 4, a second connecting link 62 is pivotally connectable to the second rod assembly 82 for rotation about a third axis 73. A second tie bar arm 52 is attachable to a second one of the two marine propulsion devices. The second tie bar arm 52 is pivotally connectable to the second connecting link 62 for rotation about a fourth axis 74.

With continued reference to FIG. 4, the first tie bar arm 51 comprises a first attachment plate 91 and a second attachment plate 92. The first and second attachment plates, 91 and 92, are generally parallel to each other. The first connecting link 61 is disposable between the first and second attachment plates, 91 and 92. The first axis 71 extends through the first and second attachment plates, 91 and 92, and through the first connecting link 61. The first connecting link 61 comprises a first clevis end 96. The first rod assembly 81 is disposed within the first clevis end 96. The second axis 72 extends through the first rod assembly 81 and through the first clevis end 96.

With continued reference to FIG. 4, it can be seen that rotation of the coupler 100 in the direction identified as R1 will cause the first and second connecting links, 61 and 62, to be drawn toward each other because of the different threads at the two ends of the coupler 100 and the different threads on the first and second rod assemblies, 81 and 82. Conversely, rotation of the coupler 100 in the direction identified as R2 in FIG. 4 will cause the first and second connecting links, 61 and 62, to move apart. By selective rotation of the coupler 100, the precise distance between the first and fourth axes of rotation, 71 and 74, can be accurately determined. Locking nuts, 111 and 112, are used to prevent inadvertent rotation of the coupler 100 relative to the first and second rod assemblies, 81 and 82.

Figure 5:
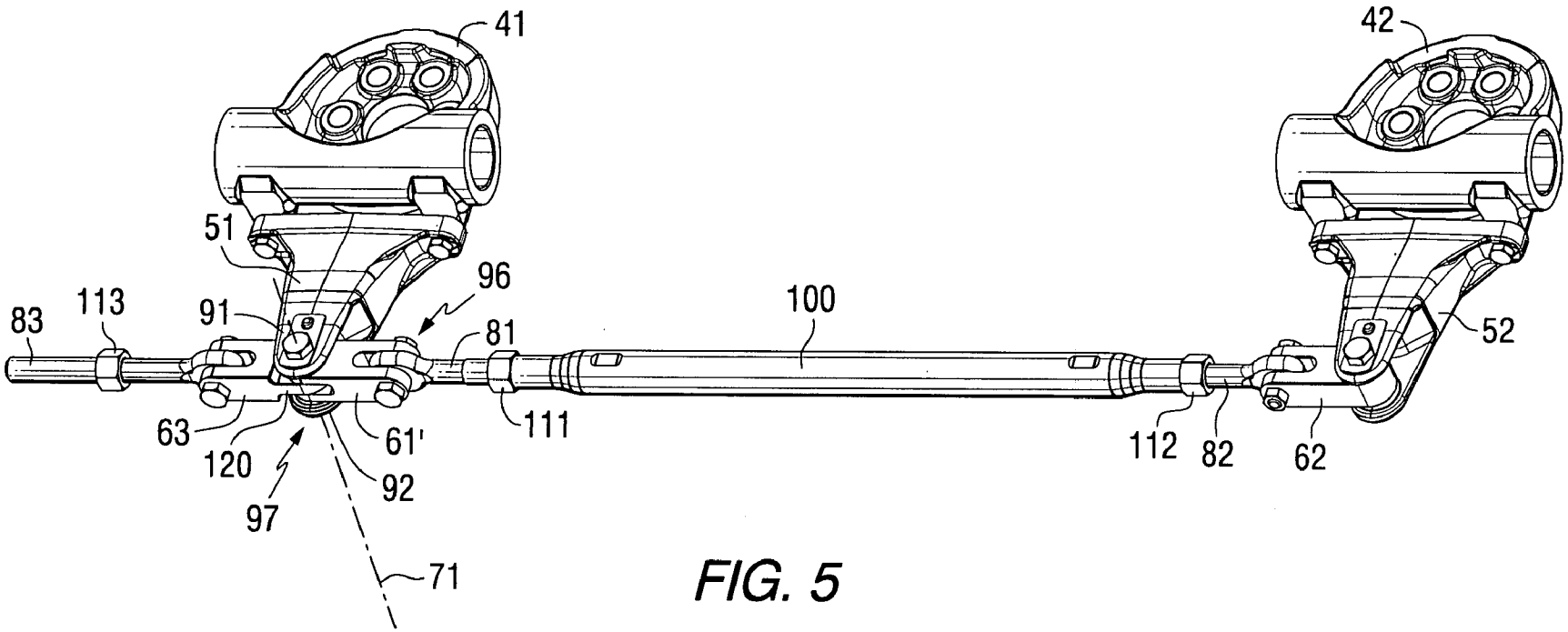
FIG. 5 shows the present invention used in a manner which connects three outboard motors together.

FIG. 5 is generally similar to FIG. 4, except that it shows a slightly different embodiment of the present invention which is intended for use when three or more marine propulsion devices are used in tandem. It should me understood that, if three or more outboard motors are used in tandem, the arrangement shown in FIG. 5 is repeated as many times as are required. The first and second tie bar arms, 51 and 52, are identical to those described above in conjunction with FIG. 4. The difference in the embodiment shown in FIG. 5 is that the first connecting link 61' is formed differently than the first connecting link 61 described above in conjunction with FIG. 4. The first connecting link 61' in FIG. 5 comprises a second clevis end 97 which is disposed between the first and second attachment plates, 91 and 92. The first axis 71 extends through the first and second attachment plates, 91 and 92, and through the second clevis end 97 of the first connecting link 61'. The second clevis end 97 is shaped to receive an extension portion 120 of a third connecting link 63. The remaining components to the left of the third connecting link 63 are similar to the components described above in conjunction with FIGS. 4 and 5 and which are located between the first and second connecting links 61 and 62. As illustrated in FIG. 5, these components would comprise a third rod assembly 83 and another coupler that is similar to the coupler identified by reference numeral 100 in FIG. 5.

Figure 6:
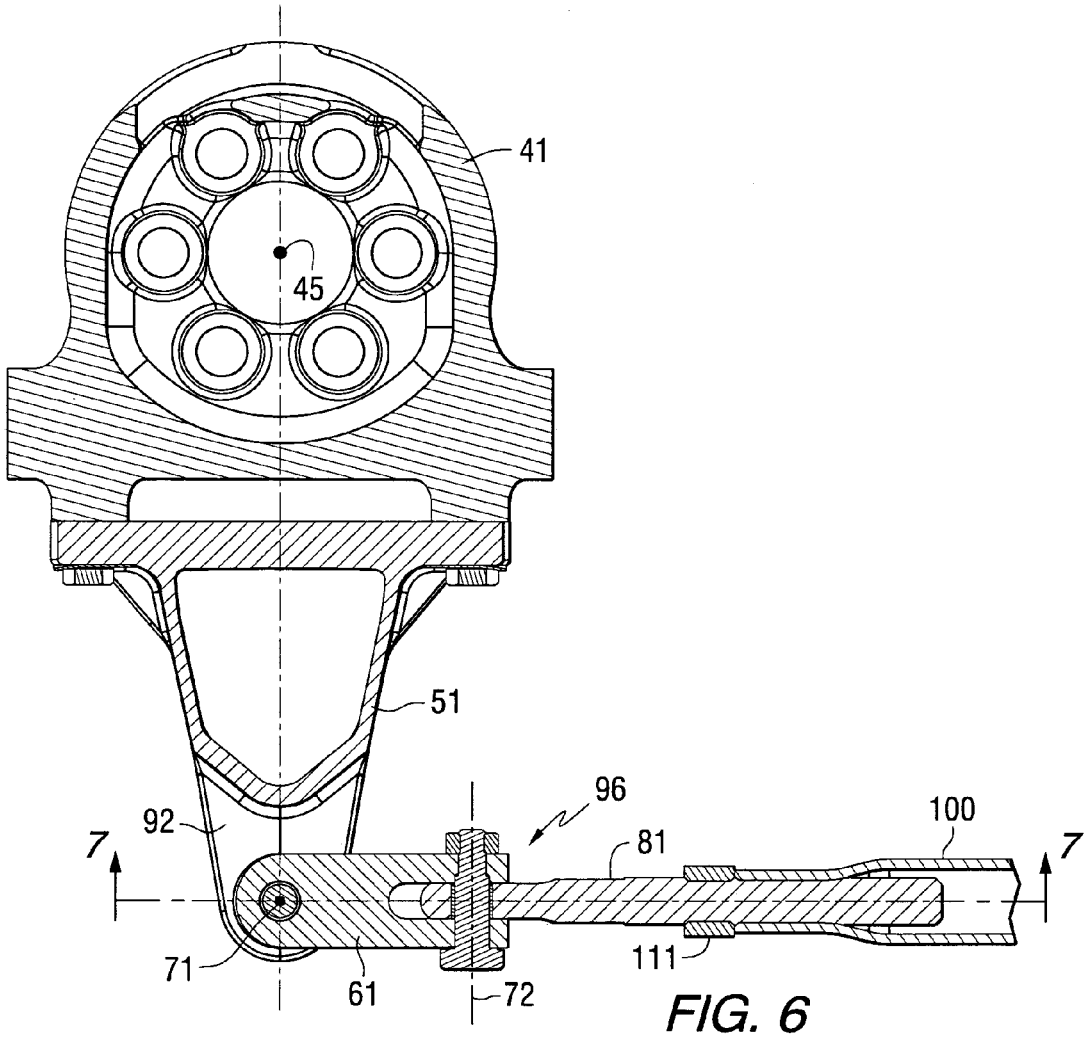
FIGS. 6 and 7 are section views of the present invention shown in FIG. 4.
Figure 7:
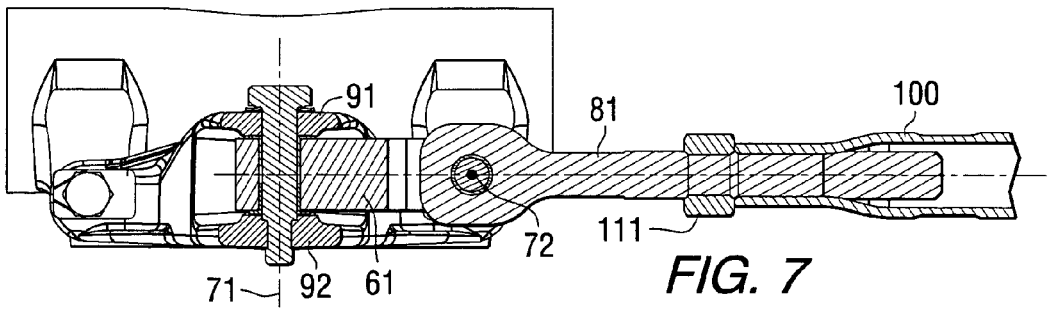

FIG. 6 is a section view of the first tie bar arm 41, the first connecting link 61, and the first rod assembly 81 with associated components which include the coupler 100. FIG. 7 is a section view taken through the first rod assembly 81 and first connecting link 61 as shown.

With reference to FIGS. 6 and 7, the relationship between the first connecting link 61 and the first and second axes, 71 and 72, can be seen. In addition, the first clevis end 96 illustrates its relationship to both the first rod assembly 81 and the second axis 72. In addition, it can be seen that the first connecting link 61 is disposed between the first and second attachment plates, 91 and 92, of the first tie bar arm 51.

In FIGS. 6 and 7, it can also be seen that the first and second axes, 71 and 72, are generally perpendicular to each other and are arranged in nonintersecting association with each other. The locking nut 111 is shown in its relationship to both the coupler 100 and the first rod assembly 81. FIGS. 6 and 7 show the application of the present invention in conjunction with an outboard motor that is connected in tandem with another outboard motor (not shown in FIGS. 6 and 7).

Figure 8:
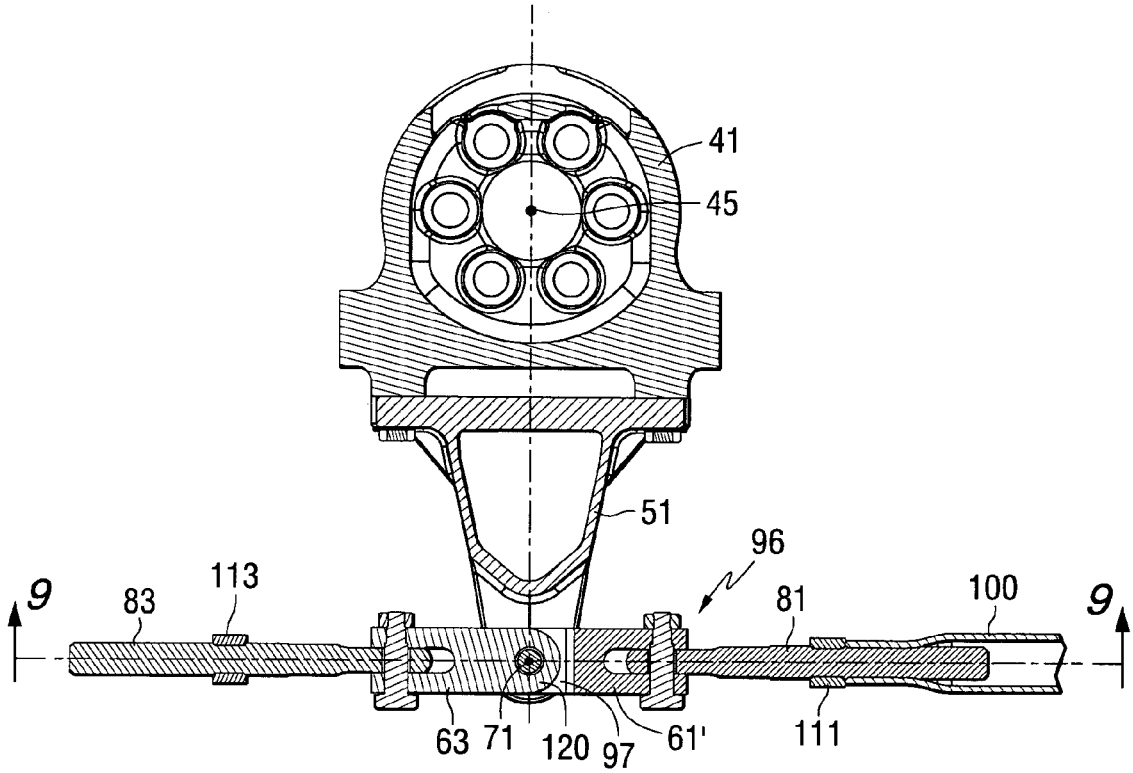
FIGS. 8 and 9 are section views of the present invention as shown in FIG. 6.
Figure 9:
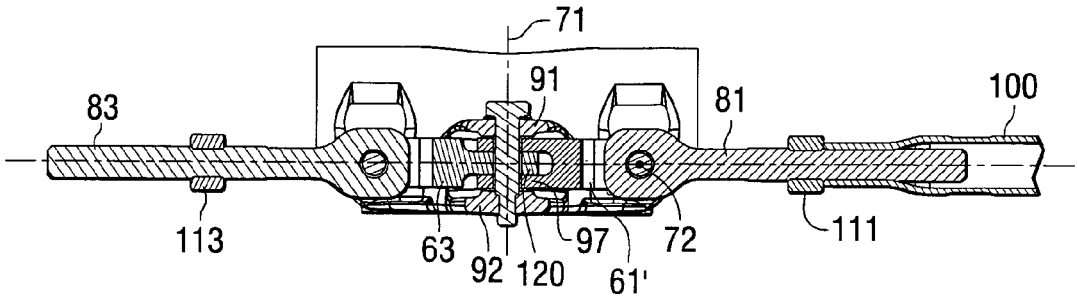

FIG. 8 is a section view of a first tie bar arm 51. FIG. 9 is a section view of FIG. 8 as shown. The primary differences between FIGS. 8 and 9, compared to FIGS. 6 and 7, relate to the fact that the first connecting link 61' is provided with both first and second clevis ends, 96 and 97, respectively. These can be seen by viewing FIGS. 8 and 9 together. The provision of the second clevis end 97 allows the extension portion 120 of the third connecting link 63 to be disposed within the second clevis end 97 to allow the combined connection of the first and second connecting links, 61' and 63, to be connected as shown in FIGS. 8 and 9 for rotation about axis 71.

The arrangement shown in FIGS. 8 and 9 represents the type of connection shown in FIG. 5, wherein three or more outboard motors are connected to each other. As an example, the first tie bar arm 51 in FIGS. 5, 8, and 9 represents the center outboard motors located between two other outboard motors and connected to those two outboard motors with couplers 100 as described above. In order to facilitate this connection of two other outboard motors to the one to which the first tie bar arm 51 is attached, the first connecting link 61' is configured with a second clevis end 97 that allows the extension portion 120 of a third connecting link 63 to be connected in combination with the first connecting link 61 and the first and second attachment plates, 91 and 92, as shown in FIG. 9 for common rotation about the first axis 71.

Figure 10:
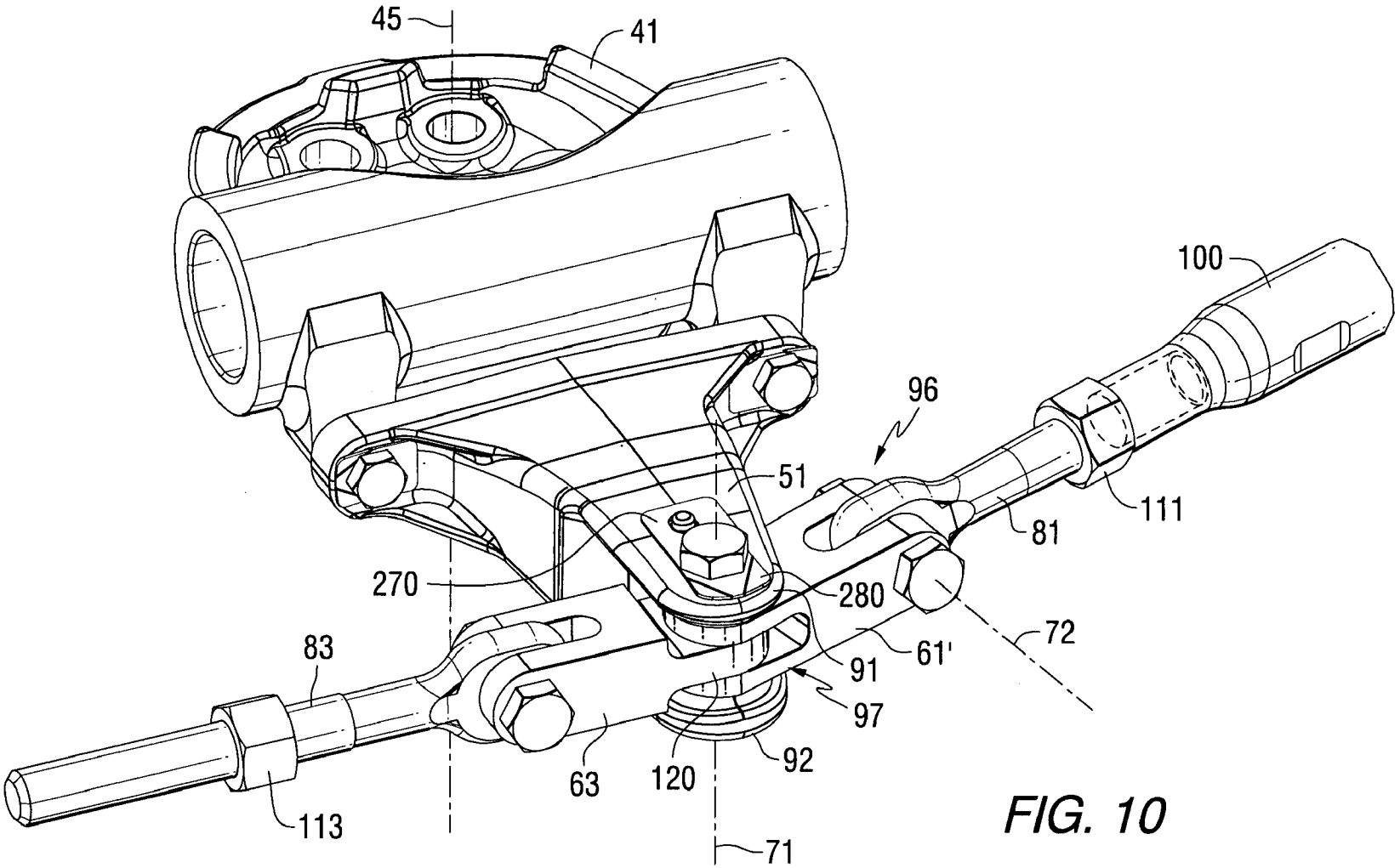
FIG. 10 is an isometric view showing a central outboard motor connection of the present invention when it is used to connect three outboard motors together.

FIG. 10 is an isometric view of the first tie bar arm 51 associated with the first connecting link 61' and the third connecting link 63. FIG. 10 shows the relationship between the second clevis end 97 of the first connecting link 61' and the extension portion 120 of the third connecting link 63. The first and third connecting links, 61' and 63, allow the first and third rod assemblies, 81 and 83, to rotate independently about the first axis 71 while remaining attached to the first and second attachment plates, 91 and 92, of the first tie bar arm 51. The other components identified in FIG. 10 are described above and will not be described again in conjunction with FIG. 10.

Figure 11:
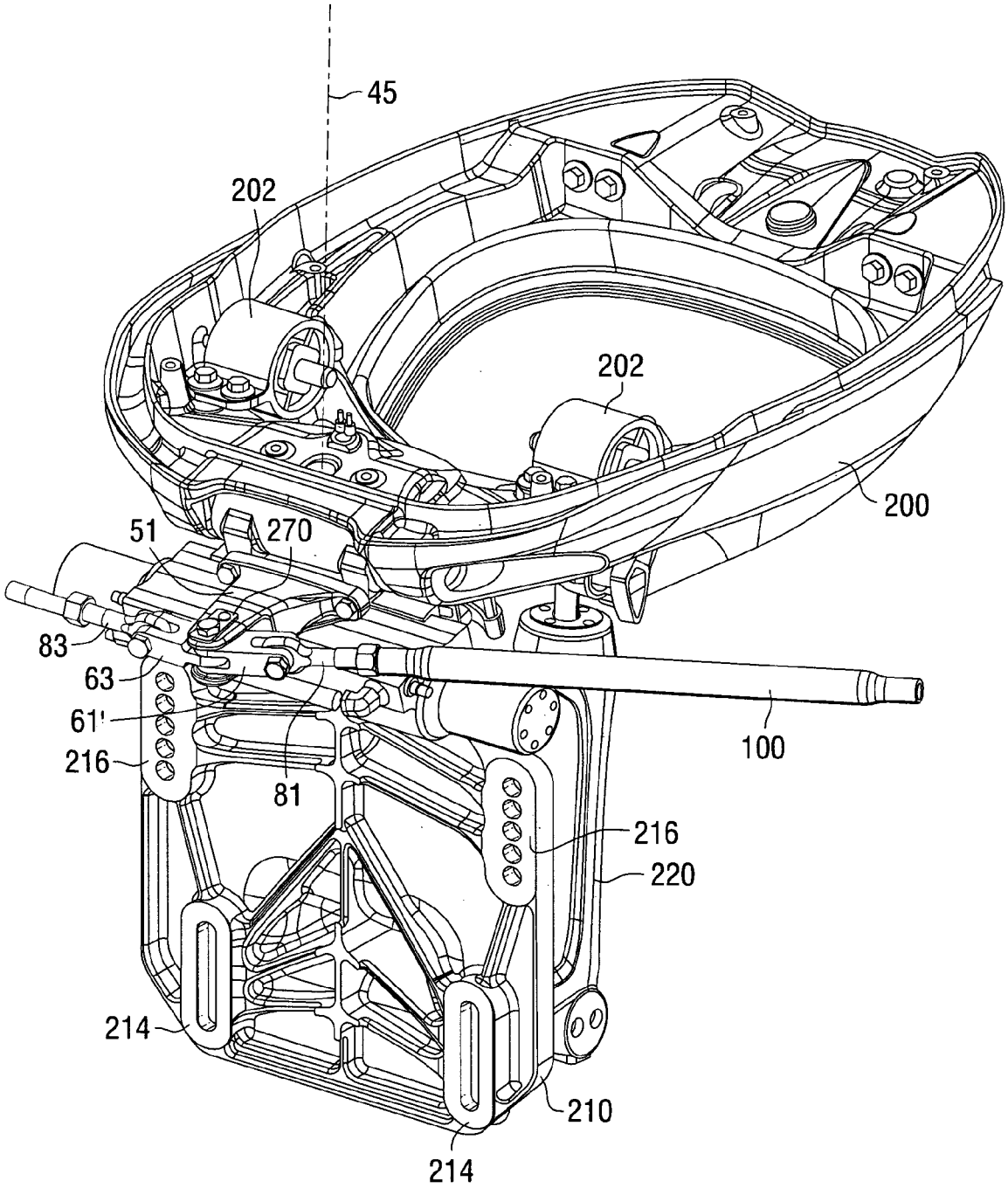
FIG. 11 is an isometric view similar to FIG. 10, but also showing a pedestal and mounting cradle of an outboard motor.

FIG. 11 is an isometric view of the first tie bar arm 51 attached to a steering head of an outboard motor. The steering head is connected to the mounting cradle 200 of an engine of the outboard motor with a pin attaching it to the mounting cradle. The outboard motor is supported by a support plate attached to the mounting cradle 200 and supported by resilient mounts, such as those identified by reference numeral 202. A pedestal 210 is attachable to a transom of a marine vessel, with surfaces 214 and 216 being disposed in contact with the rearward surface of the transom. A trim cylinder 220 is also visible in FIG. 11. The primary intent of FIG. 11 is to show the present invention in association with other components of an outboard motor to more clearly illustrate the relationship and location of the components of the present invention in conjunction with the outboard motor. The steering axis 45 of the outboard motor is illustrated in FIG. 11 to show the axis about which the outboard motor rotates in response to forces provided by the couplers 100 on the first tie bar arm 51. Two or more such outboard motors would be connected to the transom of a marine vessel and caused to rotate about their respective steering axis in tandem with each other.

Figure 12:
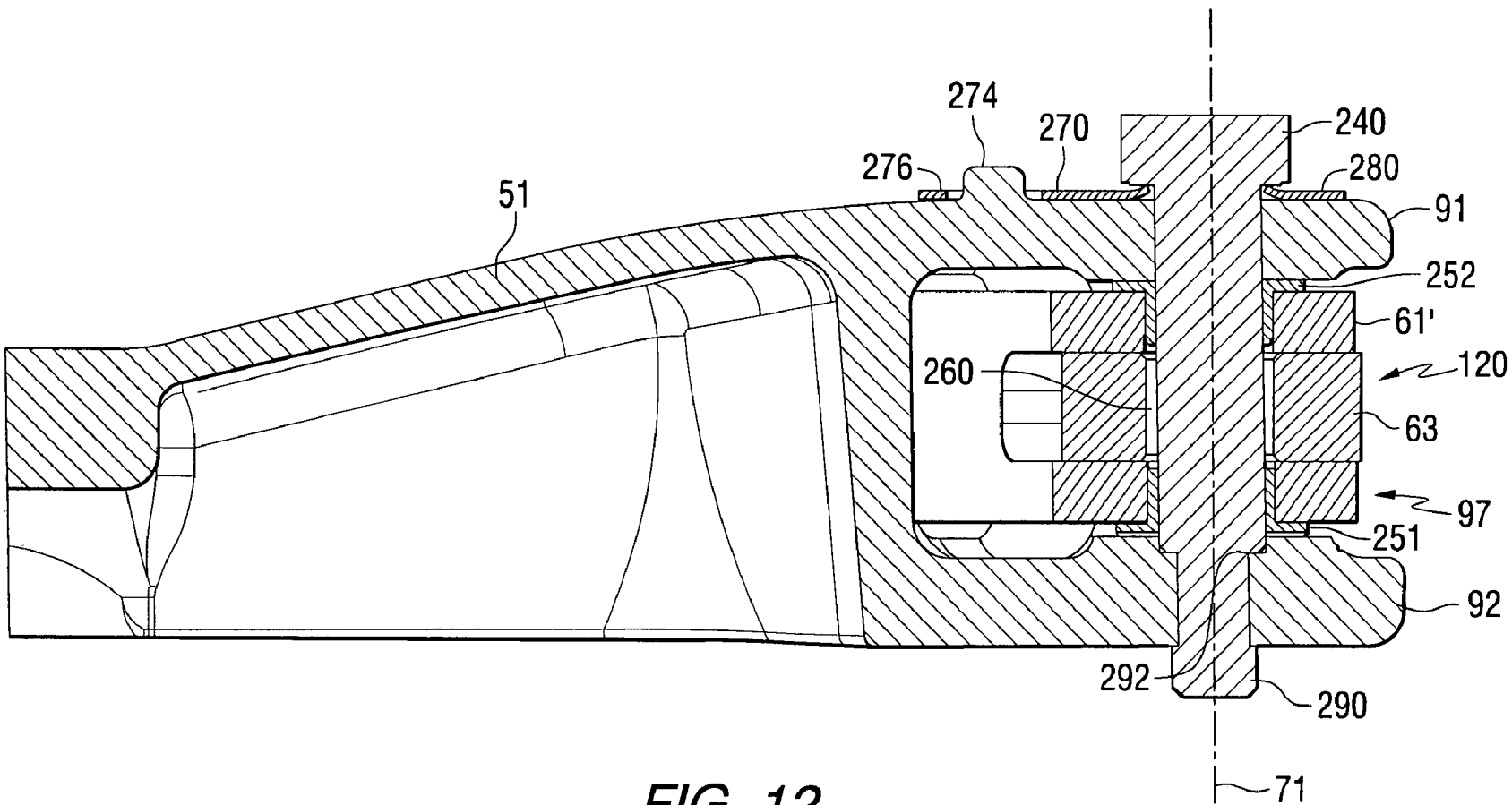
FIG. 12 is a section view of a tie bar arm when it is used as a central point of the present invention for connecting three outboard motors together.

FIG. 12 is a section view of the first tie bar arm 51 when used in conjunction with first and third connecting links, 61' and 63. The second clevis end 97 of the first connecting link 61' is shaped to receive the extension portion 120 within it. Both the second clevis end 97 and the extension portion 120 are disposed between the first and second attachment plates, 91 and 92, of the first tie bar arm 51. A bolt 240 extends through the first tie bar arm 51 and through the first connecting link 61' coaxially with the first axis 71. The bolt 240 is a shoulder bolt which is sized to retain the first connecting link 61' in an uncompressed state between the first and second attachment plates, 91 and 92. At least one flanged radial bearing, illustrated as flanged radial bearing 251 and 252 in FIG. 12, is disposed around the bolt 240 and between the first and second attachment plates, 91 and 92. A non-flanged radial bearing 260 is disposed around the bolt 240 and between the first and second attachment plates, 91 and 92.

Also shown in FIG. 12 is a retainer tab 270 that is located under the head of bolt 240 and on the top surface of the first attachment plate 91. A protrusion 274 extends upwardly from the first attachment plate 91 and through an opening 276 formed in the retainer tab 270. This prevents the retainer tab 270 from rotating about the first axis 71. An edge 280 of the retainer tab 270 can be bent upwardly to lock the head of the bolt 240 and prevent it from rotating about the first axis 71.

With continued reference to FIG. 12, it can be seen that the distal end 290 of the bolt 240 is threaded to be attached in threaded association with accommodating threads in the second attachment plate 92. The bolt 240 is provided with a shoulder 292 which abuts a similarly shaped shoulder in the second attachment plate 92 above the threads that mesh with the threads of the bolt 240. This defines the depth to which the bolt 240 can be moved downwardly relative to the first and second attachment plates, 91 and 92. The use of the shoulder 292 prevents the first and second attachment plates, 91 and 92, from being compressed towards each other by an overtightening of the bolt 240. In other words, the location of the shoulder 292 assures that the first and second connecting links, 61' and 63, are not compressed between the first and second attachment plates, 91 and 92, as a result of the bolts 240 being overtightened. The bearings, 251 and 252, also assure that the first and second connecting links, 61' and 63, are free to rotate about the first axis 71.

With reference to FIGS. 4–12, it has been shown that the connection system for connecting two marine propulsion devices together, according to a preferred embodiment of the present invention, comprises a first tie bar 51 which is attachable to a first one of the two marine propulsion devices and a first connecting link 61 which is pivotally connectable to the first tie bar arm 51 for rotation about a first axis 71. The present invention further comprises a first rod assembly 81 which is pivotally connectable to the first connecting link 61 for rotation about a second axis 72. A coupler 100 is attachable in a first direction of threaded association with the first rod assembly 81 and a second rod assembly 82 is attachable in a second direction of threaded association with a coupler 100. The first and second directions of threaded association are opposite to each other, with one using a left hand thread and the other using a right hand thread.

A second connecting link 62 is pivotally connectable to the second rod assembly 82 for rotation about a third axis 72. A second tie bar arm 52 is attachable to a second one of the two marine propulsion devices, or outboard motors. The second tie bar arm 52 is pivotally connectable to the second connecting link 62 for rotation about a fourth axis 74. The first tie bar arm 51 comprises a first attachment plate 91 and a second attachment plate 92. The first and second attachment plates, 91 and 92, are generally parallel to each other. The first connecting link 61 is disposable between the first and second attachment plates. The first axis 71 extends through the first and second attachment plates, 91 and 92, and also through the first connecting link 61. The first connecting link 61 comprises a first clevis end 96. The first rod assembly 81 is disposed within the first clevis end 96. The second axis 72 extends through the first rod assembly 81 and through the first clevis end 96.

In certain embodiments of the present invention, where three outboard motors are to be connected in tandem together, the first connecting link 61' comprises a second clevis end 97 which is disposed between the first and second attachment plates, 91 and 92. The first axis 71 extends through the first and second attachment plates and through the second clevis end 97. The second clevis end is shaped to receive an extension portion 120 of a third connecting link 63.

The first and second axes, 71 and 72, extend in directions which are generally perpendicular to each other. The first and second axes are arranged in nonintersecting association with each other and separated by a distance which is determined by the size of the connecting link. The first direction of threaded association, which attaches the coupler 100 to the rod assemblies, employs a right handed thread and a left handed thread, one for each of the first and second rod assemblies. The first and second rod assemblies, 81 and 82, are moved toward each other in response to rotation of the coupler 100 in a first direction R1 about its central axis and are moved away from each other in response to rotation of the coupler 100 in an opposite direction R2 about its central axis. This results from the use of two oppositely configured threads at the two ends of the coupler 100 and the corresponding use of two rod assemblies, 81 and 82, that are provided with oppositely directed threads.

A bolt 240 extends through the first tie bar arm 51 and through the first connecting link, 61 or 61'. It should be understood that the first tie bar arm 51 and the first connecting link are configured in one manner when two outboard motors are connected together in tandem and the first connecting link 61' is configured in another manner to suit the connection of three or more outboard motors together. The bolt 240 is a shoulder bolt which is sized to retain the first connecting link in an uncompressed state between the first and second attachment plates, 91 and 92. At least one flanged radial bearing, 251 and 252, is disposed around the bolt 240 and between the first and second attachment plates. A non-flanged radial bearing 260 is disposed around the bolt 240 between the first and second attachment plates. A first resultant force F exerted by the first connecting link 61 on the first tie bar arm 51 is symmetrical with a second resultant force R exerted by the first tie bar arm 51 on the first connecting link 61. The first and second resultant forces are generally equal in magnitude and directed in opposite directions along a common axis. It should be understood that when a pair of connection plates, 91 and 92, or the arms of a clevis end are used, either the first resultant force or the second resultant force will actually comprise two forces distributed between either the first and second attachment plates, 91 and 92, or the two arms of a clevis end. As a result, the first and second resultant forces, F and R, combine to create approximately no net moment about any point. As a result of the structure of the present invention, the system is easily assembled and adjusted. The coupler 100 can be rotated about its centerline in either a first rotational direction R1 or a second rotational direction R2 to adjust the distance between the first and fourth axes. This can easily be done without having to detach the coupler 100 from its associated components or having to disconnect the connecting links, 61 and 62, from their respective tie bar arms. In addition, the use of the clevis ends of the connecting links and the use of both first and second attachment plates of the first and second tie bar arms distributes the forces and their reactions in such a way that resulting moments are avoided. Therefore, bending forces on the various components are eliminated or significantly reduced.

Although the present invention has been described with particular specificity to show preferred embodiments and illustrated to show a particular structure, it should be understood that alternative embodiments are also within its scope.

We claim:

1. A connection system for connecting two marine propulsion devices together, comprising:

a first tie bar arm which is attachable to a first one of said two marine propulsion devices;

a first connecting link which is pivotally connectable to said first tie bar arm for rotation about a first axis;

a first rod assembly which is pivotally connectable to said first connecting link for rotation about a second axis;

a coupler which is attachable in a first direction of threaded association with said rod assembly; and a second rod assembly which is attachable in a second direction of threaded association with said coupler, said first and second directions of threaded association being opposite to each other.

2. The connection system of claim 1, further comprising:

a second connecting link which is pivotally connectable to said second rod assembly for rotation about a third axis.

3. The connection system of claim 2, further comprising:

a second tie bar arm which is attachable to a second one of said two marine propulsion devices, said second tie bar arm being pivotally connectable to said second connecting link for rotation about a fourth axis.

4. The connection system of claim 1, wherein:

said first tie bar arm comprises a first attachment plate and a second attachment plate, said first and second attachment plates being generally parallel to each other, said first connecting link being disposable between said first and second attachment plates, said first axis extending through said first and second attachment plates and through said first connecting link.

5. The connection system of claim 1, wherein:

said first connecting link comprises a first clevis end, said first rod assembly being disposed within said first clevis end, said second axis extending through said first rod assembly and through said first clevis end.

6. The connection system of claim 1, further comprising:

said first tie bar arm comprises a first attachment plate and a second attachment plate, said first and second attachment plates being generally parallel to each other, said first axis extending through said first and second attachment plates and through said first connecting link;

said first connecting link comprises a first clevis end, said first rod assembly being disposed within said first clevis end, said second axis extending through said first rod assembly and through said first clevis end; and said first connecting link comprises a second clevis end which is disposed between said first and second attachment plates, said first axis extending through said first and second attachment plates and through said second clevis end, said second clevis end being shaped to receive an extension portion of a third connecting link.

7. The connection system of claim 1, wherein:

said first and second axes extend in directions which are perpendicular to each other.

8. The connection system of claim 1, wherein:

said first direction of threaded association employs a right handed thread and said second direction of threaded association employs a left handed thread.

9. The connection system of claim 1, wherein:

said first direction of threaded association employs a left handed thread and said second direction of threaded association employs a right handed thread.

10. The connection system of claim 1, wherein:

said first and second rod assemblies are moved toward each other in response to rotation of said coupler in a first rotational direction about its central axis and said first and second rod assemblies are moved away from each other in response to rotation of said coupler in a second rotational direction about its central axis, said first and second rotational directions being opposite to each other.

11. The connection system of claim 4, further comprising:

a bolt extending through said first tie bar arm and through said first connecting link coaxially with said first axis.

12. The connection system of claim 11, wherein:

said bolt is a shoulder bolt which is sized to retain said first connecting link in an uncompressed state between said first and second attachment plates.

13. The connection system of claim 11, further comprising:

at least one flanged radial bearing disposed around said bolt and between said first and second attachment plates.

14. The connection system of claim 13, further comprising:

a non-flanged radial bearing disposed around said bolt and between said first and second attachment plates.

15. The connection system of claim 1, wherein:

a first resultant force exerted by said first connecting link on said first tie bar arm is symmetrical with a second resultant force exerted by said first tie bar arm on said first connecting link, said first and second resultant forces being generally equal in magnitude and directed in opposite directions along a common axis.

16. The connection system of claim 15, wherein:

said first and second resultant forces combine to create approximately no net moment about any point.

17. A connection system for connecting two marine propulsion devices together, comprising:

a first tie bar arm which is attachable to a first one of said two marine propulsion devices;

a first connecting link which is pivotally connectable to said first tie bar arm for rotation about a first axis;

a first rod assembly which is pivotally connectable to said first connecting link for rotation about a second axis, said first and second axes extending in nonintersecting directions which are generally perpendicular to each other;

a coupler which is attachable in a first direction of threaded association with said rod assembly; and a second rod assembly which is attachable in a second direction of threaded association with said coupler, said first and second directions of threaded association being opposite to each other, said first tie bar arm comprising a first attachment plate and a second attachment plate, said first and second attachment plates being generally parallel to each other, said first connecting link being disposable between said first and second attachment plates, said first axis extending through said first and second attachment plates and through said first connecting link.

18. The connection system of claim 17, further comprising:

a second connecting link which is pivotally connectable to said second rod assembly for rotation about a third axis.

19. The connection system of claim 18, further comprising:

a second tie bar arm which is attachable to a second one of said two marine propulsion devices, said second tie bar arm being pivotally connectable to said second connecting link for rotation about a fourth axis.

20. The connection system of claim 19, wherein:

said first connecting link comprises a first clevis end, said first rod assembly being disposed within said first clevis end, said second axis extending through said first rod assembly and through said first clevis end.

21. The connection system of claim 20, wherein:

said first connecting link comprises a second clevis end which is disposed between said first and second attachment plates, said first axis extending through said first and second attachment plates and through said second clevis end, said second clevis end being shaped to receive an extension portion of a third connecting link.

22. The connection system of claim 20, wherein:

said first direction of threaded association employs a right handed thread and said second direction of threaded association employs a left handed thread.

23. The connection system of claim 17, wherein:

said first and second rod assemblies are moved toward each other in response to rotation of said coupler in a first rotational direction about its central axis and said first and second rod assemblies are moved away from each other in response to rotation of said coupler in a second rotational direction about its central axis, said first and second rotational directions being opposite to each other.

24. The connection system of claim 17, further comprising:

a bolt extending through said first tie bar arm and through said first connecting link coaxially with said first axis.

25. The connection system of claim 24, wherein:

said bolt is a shoulder bolt which is sized to retain said first connecting link in an uncompressed state between said first and second attachment plates.

26. The connection system of claim 25, further comprising:

at least one flanged radial bearing disposed around said bolt and between said first and second attachment plates.

27. The connection system of claim 17, wherein:

a first resultant force exerted by said first connecting link on said first tie bar arm is symmetrical with a second resultant force exerted by said first tie bar arm on said first connecting link, said first and second resultant forces being generally equal in magnitude and directed in opposite directions along a common axis.

28. The connection system of claim 27, wherein:

said first and second resultant forces combine to create approximately no net moment about any point.

29. A connection system for connecting two marine propulsion devices together, comprising:

a first tie bar arm which is attachable to a first one of said two marine propulsion devices;

a first connecting link which is pivotally connectable to said first tie bar arm for rotation about a first axis;

a first rod assembly which is pivotally connectable to said first connecting link for rotation about a second axis, said first and second axes extending in nonintersecting directions which are generally perpendicular to each other;

a coupler which is attachable in a first direction of threaded association with said rod assembly; and a second rod assembly which is attachable in a second direction of threaded association with said coupler, said first and second directions of threaded association being opposite to each other, whereby said first and second rod assemblies are moved toward each other in response to rotation of said coupler in a first rotational direction about its central axis and said first and second rod assemblies are moved away from each other in response to rotation of said coupler in a second rotational direction about its central axis, said first and second rotational directions being opposite to each other, said first tie bar arm comprising a first attachment plate and a second attachment plate, said first and second attachment plates being generally parallel to each other, said first connecting link being disposable between said first and second attachment plates, said first axis extending through said first and second attachment plates and through said first connecting link.

30. The connection system of claim 29, further comprising:

a second connecting link which is pivotally connectable to said second rod assembly for rotation about a third axis.

31. The connection system of claim 30, further comprising:

a second tie bar arm which is attachable to a second one of said two marine propulsion devices, said second tie bar arm being pivotally connectable to said second connecting link for rotation about a fourth axis.

32. The connection system of claim 31, wherein:

said first connecting link comprises a first clevis end, said first rod assembly being disposed within said first clevis end, said second axis extending through said first rod assembly and through said first clevis end.

33. The connection system of claim 32, wherein:

said first connecting link comprises a second clevis end which is disposed between said first and second attachment plates, said first axis extending through said first and second attachment plates and through said second clevis end, said second clevis end being shaped to receive an extension portion of a third connecting link.

34. The connection system of claim 29, further comprising:

a bolt extending through said first tie bar arm and through said first connecting link coaxially with said first axis.

35. The connection system of claim 34, wherein:

said bolt is a shoulder bolt which is sized to retain said first connecting link in an uncompressed state between said first and second attachment plates.

36. The connection system of claim 35, further comprising:

at least one flanged radial bearing disposed around said bolt and between said first and second attachment plates.

37. The connection system of claim 29, wherein:

a first resultant force exerted by said first connecting link on said first tie bar arm is symmetrical with a second resultant force exerted by said first tie bar arm on said first connecting link, said first and second resultant forces being generally equal in magnitude and directed in opposite directions along a common axis.

38. The connection system of claim 37, wherein:

said first and second resultant forces combine to create approximately no net moment about any point.

* * * * *